US008157193B2

(12) United States Patent
Avant, Jr. et al.

(10) Patent No.: US 8,157,193 B2
(45) Date of Patent: Apr. 17, 2012

(54) WATERLESS SEPARATION METHODS AND SYSTEMS FOR COAL AND MINERALS

(75) Inventors: David M. Avant, Jr., Sandersville, GA (US); Riley D. Robbins, Beckley, WV (US)

(73) Assignee: Robbins & Avant Mineral Ventures, LLC, Sandersville, GA (US)

( * ) Notice: Subject to any disclaimer, the term of this patent is extended or adjusted under 35 U.S.C. 154(b) by 275 days.

(21) Appl. No.: 12/685,754

(22) Filed: Jan. 12, 2010

(65) Prior Publication Data

US 2010/0176226 A1 Jul. 15, 2010

Related U.S. Application Data

(60) Provisional application No. 61/144,247, filed on Jan. 13, 2009, provisional application No. 61/157,335, filed on Mar. 4, 2009.

(51) Int. Cl.
*B02C 19/00* (2006.01)

(52) U.S. Cl. ..... 241/14; 241/23; 241/24.24; 241/24.31

(58) Field of Classification Search ..... 241/14, 241/19, 23, 24.24, 24.31, 79.1
See application file for complete search history.

(56) References Cited

U.S. PATENT DOCUMENTS 3,999,958 A * 12/1976 Iannicelli ..... 44/623
5,570,517 A 11/1996 Luker

* cited by examiner

*Primary Examiner* — Faye Francis
(74) *Attorney, Agent, or Firm* — Myers Bigel Sibley & Sajovec, P.A.

(57) ABSTRACT

A waterless method of processing coal to remove impurities therefrom includes drying a batch of coal to remove moisture therefrom, pulverizing the coal into individual coal particles to liberate impurity particles from the coal and without substantially reducing the size of the impurity particles, and separating the impurity particles and pulverized coal particles into respective product streams via air classification. The dryer includes a plurality of rotating paddles, and an air stream forces the coal through the plurality of rotating paddles to pulverize the coal into individual particles and liberate the impurities.

8 Claims, 5 Drawing Sheets

WATERLESS SEPARATION METHODS AND SYSTEMS FOR COAL AND MINERALS

RELATED APPLICATIONS

This application claims the benefit of and priority to U.S. Provisional Patent Application No. 61/144,247, filed Jan. 13, 2009, and U.S. Provisional Patent Application No. 61/157,335, filed Mar. 4, 2009, the disclosures of which are incorporated herein by reference as if set forth in their entireties.

FIELD OF THE INVENTION

The present invention relates generally to minerals and, more particularly, to mineral processing.

BACKGROUND

Hundreds of millions of tons of discarded coal litter the landscape in coal producing regions throughout the United States. Discarded coal includes run-of-mine coal and previously processed or waste coal. Run of mine coal is coal discharged from mining operations prior to processing. It is produced from both underground mining operations and open pit mining or surface mining operations. Run-of-mine coal often contains unwanted impurities such as rock, minerals, and dirt, and comes in a mixture of different-sized fragments.

Waste coal is sometimes referred to as "gob" (garbage of bituminous) or "boney" in the bituminous coal mining regions of western Pennsylvania and West Virginia. Millions of tons of waste coal are deposited in coal ponds and gob piles in these mining regions, as well as in the Appalachian coal region including Virginia, Kentucky, and Alabama, as well as in the Midwest, (e.g., the Illinois basin, Indiana, etc.). Coal ponds and gob piles include coal that has been previously mined and processed, and contain coal of various qualities and sizes. Gob piles and coal ponds often contain coal particle that are small in size and that have high ash content (i.e., non-coal minerals and impurities). This is because, in the past, coal use often focused on larger particle sizes.

Moreover, because of limited knowledge and technology, run-of-mine coal below about one-quarter of an inch (¼") in size typically was discarded. In addition, various industries typically required coal having a particular ash content. The coal not complying with the required ash content after beneficiation processing was discarded. For example, coal processed for high grade markets, such as the steel industry, was often washed to provide a low ash content (e.g., about 4% ash). Coal utilized in electricity generating power plants ("thermal coal") was often washed so as to have an ash content of 10% to 15%.

Discarded coal typically has a lower energy value than pure coal. However, because of increasing energy demands and because of environmental concerns, it has become desirable to remove and reclaim discarded coal from gob piles, ponds, and other disposal locations.

The processing of coal to remove impurities for both the thermal, metallurgical and petroleum coal markets has historically been accomplished via wet processes involving crushing and float/sink separation based on specific gravity. Current practices for cleaning coal involve crushing to liberate impurities and submitting various size fractions to float/sink devices and circuits to isolate coal from the impurities such as silica, clay, and sulfur. For example, after coal is crushed, it is separated into various-sized fragments. The coal can then be separated from other impurities, such as rock, by being floated in a tank containing a high-density liquid.

Because the coal is lighter, it floats and is separated off, while heavier rock and other impurities sink and are removed as waste. Unfortunately, because discarded coal may contain as much as 50% ash, conventional ash-removal techniques may not be effective or efficient in reclaiming discarded coal. The larger a coal particle, the more likely that the coal particle will have impurities entrained therein. In conventional float/sink coal processing components, a given coal particle will report based upon the average of the specific gravity or density of the particle. For example, a lump crushed to two inches (2") may contain about 50% "pure" coal at a specific gravity of about 1.3, about 46% silica and clay at a specific gravity of about 2.6, and about 4% sulfur at a specific gravity of about 5.0. Therefore, the coal particle exposed in a wet float sink device or circuit will report as a particle having a specific gravity of about 2.0 (the weighted average of the individual mineral components). Coal float sink processes generally function in a range from 1.30 to 1.80 specific gravity separations. As such, the pure coal in significant quantity would sink as a reject and would be discarded.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a waterless method of processing a mineral or other mined/extracted material, such as coal, kaolin, limestone, clays, slags, and the like, to remove impurities therefrom includes drying a batch of the material to remove moisture therefrom; pulverizing the material into smaller individual particles to liberate the impurity particles therefrom and without substantially reducing the size of the impurity particles; and separating the impurity particles and pulverized mineral particles into respective product streams by particle size and specific gravity.

In some embodiments, the drying and pulverizing steps may occur substantially simultaneously, and the drying step may involve injecting the mineral into a heated air stream having a flow rate through a dryer of between about ten thousand cubic feet per minute and about fifty thousand cubic feet per minute (10,000-50,000 cfm), wherein a temperature of the heated air stream is maintained between about 500° F. and 1,000° F. The dryer includes a plurality of rotating paddles, and the air stream forces the mineral through the plurality of rotating paddles to pulverize the mineral into individual particles and to liberate the impurity particles without substantially reducing the size of impurity particles. In some embodiments, the impurity particles and pulverized mineral particles are separated into respective product streams via air classification.

According to some embodiments of the present invention, a waterless method of processing coal to remove impurities therefrom includes drying a batch of coal to remove moisture therefrom; pulverizing the coal into small, individual coal particles to liberate impurity particles from the coal and without substantially reducing the size of the impurity particles; and separating the impurity particles and pulverized coal particles into respective product streams via air classification. In some embodiments, the drying and pulverizing steps may occur substantially simultaneously. In some embodiments, the drying step may involve injecting the coal into a heated air stream having a flow rate through a dryer of between about ten thousand cubic feet per minute and about fifty thousand cubic feet per minute (10,000-50,000 cfm), wherein a temperature of the heated air stream is maintained between about 500° F. and 1,000° F. The dryer includes a plurality of rotating paddles, and the air stream forces the coal through the plurality of rotating paddles to pulverize the coal into individual particles.

In some embodiments, the separating step includes producing a first product stream of ultra fine coal particles (e.g., <44 microns) and a second product stream of very fine coal particles (e.g., 660-44 microns) and impurities. The very fine coal particles in the second product stream are then pulverized into ultra fine coal particles (e.g., <44 microns) without substantially reducing the size of impurity particles in the second product stream, and the impurity particles and ultra fine coal particles are separated into respective third and fourth product streams via air classification. Pulverizing the very fine coal particles in the second product stream includes injecting the second product stream into an attrition mill having a plurality of rotating paddles, and forcing the second product stream through the plurality of rotating paddles.

In some embodiments, the ultra fine coal particles produced are pelletized for use, as well as for ease of handling and storage. Pelletizing involves compressing or molding the ultra fine coal particles into the shape of a pellet or brick.

According to some embodiments of the present invention, a waterless method of processing coal to remove impurities therefrom includes drying coal by injecting the coal into a heated air stream having a a flow rate through a dryer of between about ten thousand cubic feet per minute and about fifty thousand cubic feet per minute (10,000-50,000 cfm), wherein a temperature of the heated air stream is maintained between about 500° F. and 1,000° F.; pulverizing the coal during the drying step into small, individual coal particles to liberate impurity particles from the coal without substantially reducing the size of the liberated impurity particles; and producing, via air classification, a first product stream of fine clay particles separated from the coal and a second product stream of coal particles. The second product stream of coal particles also include impurities, and these impurities, including fine clay particles, are separated from the second product stream via another stage of air classification.

In some embodiments, the fine clay particles are subjected to calcining operations to produce calcined clay powder. The coal particles produced may be pelletized for use, as well as for ease of handling and storage.

According to some embodiments of the present invention, a waterless method of processing coal having various impurities therein, such as clay, silica, and other hard particles, includes injecting the coal into a heated air stream having a flow rate through a dryer of between about ten thousand cubic feet per minute and about fifty thousand cubic feet per minute (10,000-50,000 cfm), wherein a temperature of the air stream is maintained between about 500° F. and 1,000° F.; pulverizing the coal during the drying step into small, individual coal particles and to liberate the various impurity particles from the coal without substantially reducing the size of the liberated impurity particles. The silica particles, clay particles, and coal particles are then separated into respective product streams by particle size and specific gravity. In some embodiments, the silica particles, clay particles, and coal particles are separated into respective product streams via one or more stages of air classification.

According to some embodiments of the present invention, a waterless system for processing coal to remove impurities therefrom includes a dryer, a pulverizer, and an air classifier. The dryer is configured to remove moisture from a batch of coal, and the pulverizer is configured to pulverize the dried coal into small, individual coal particles having a size less than or equal to about 44 microns and liberate impurity particles from the coal without substantially reducing the size of the liberated impurity particles. In some embodiments, the dryer heats an air stream containing the coal to a temperature of between about 500° F. and 1,000° F. In some embodiments, the dryer includes a plurality of rotating paddles. An air stream forces the coal through the plurality of rotating paddles to pulverize the coal into small, individual particles and to liberate the impurity particles. The air classifier is configured to separate the impurity particles and pulverized coal particles into respective product streams. In some embodiments, more than one air classifier may be utilized. In some embodiments, an additional pulverizer may be located downstream of the air classifier for further pulverization of the coal and further impurity liberation. An additional air classifier may be located downstream of the additional pulverizer to further separate coal particles and impurity particles into respective product streams.

In some embodiments, the system includes a pelletizer configured to pelletize ultra fine coal particles into pellets or bricks to facilitate use, handling and/or storage. In some embodiments, the system includes a furnace for calcining fine clay particles separated from the coal.

Embodiments of the present invention are waterless, emission free, and chemical free. Neither water nor chemicals are required to separate coal and impurities contained therein. As such, slurry impoundments and streams of water-laden sludge can be eliminated.

BRIEF DESCRIPTION OF THE DRAWINGS

The accompanying drawing, which forms a part of the specification, illustrate key embodiments of the present invention. The drawing and description together serve to fully explain the invention.

DETAILED DESCRIPTION

Figure 1:
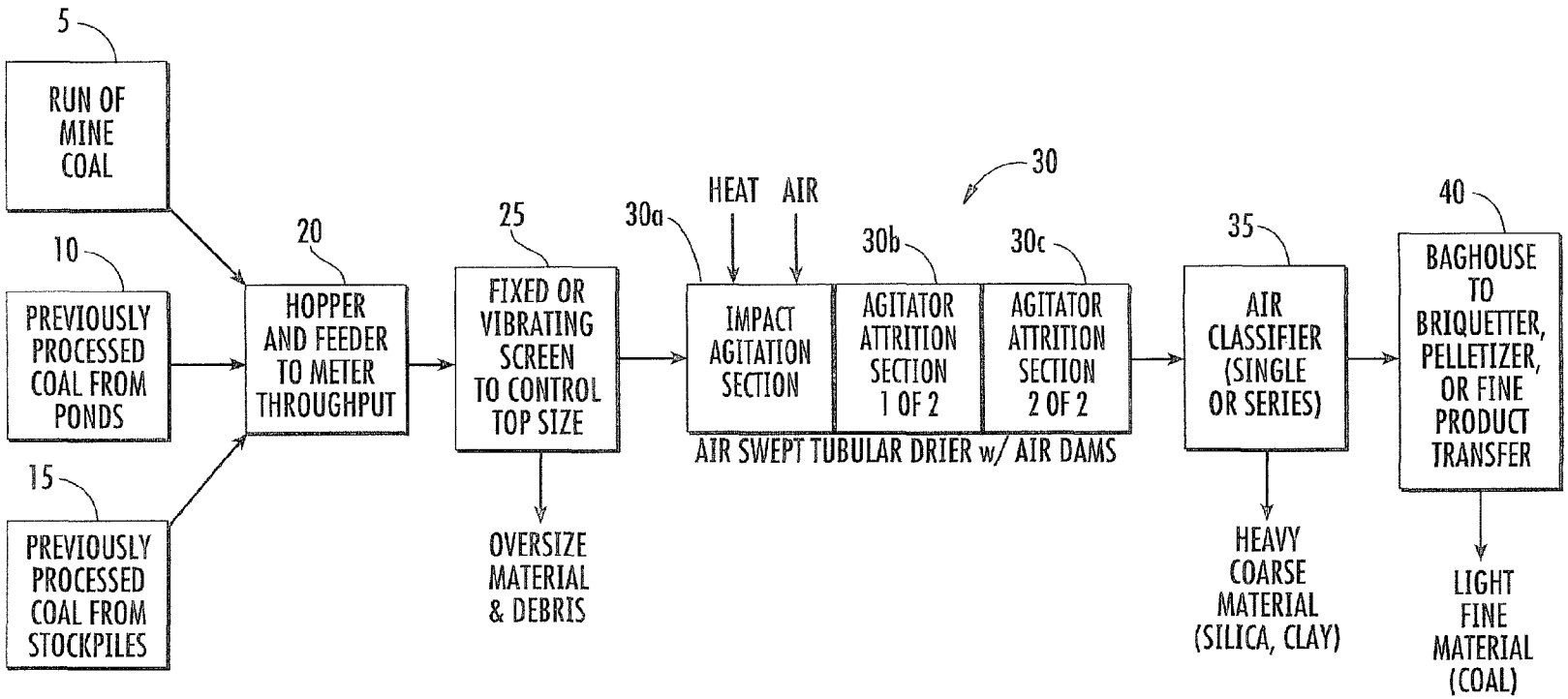
FIGS. 1-3 are block diagrams that illustrate waterless methods of processing coal and other mined/extracted materials, such as minerals, to remove impurities therefrom, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features/elements, these features/elements should not be limited by these terms. These terms are only used to distinguish one feature/element from another feature/element. Thus, a first feature/element discussed below could be termed a second feature/element, and similarly, a second feature/element discussed below could be termed a first feature/element without departing from the teachings of the present invention. Like numbers refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "discarded coal", as used herein, refers to waste coal of any type (gob piles, coal ponds, etc.), run-of-mine coal, and freshly mined coal of any type, without limitation. The terms "coal" and "discarded coal" are interchangeable in that methods and apparatus for processing coal, as described herein, may be applied to all types of coal and containing all types of impurities, without limitation.

The following table illustrates some exemplary sizes of various particles described herein. The sizes are for illustrative purposes and embodiments of the present invention are not limited to these exact particle sizes.

| Particle | Size (microns) |
|---|---|
| Fine Coal | 6700-660 |
| Very Fine Coal | 660-44 |
| Ultra Fine Coal | ≦44 |
| Fine Silica | 6700-150 |
| Very Fine Silica | 150-44 |
| Ultra Fine Silica | ≦44 |
| Fine Clay | ≦20 |
| Very Fine Clay | ≦5 |
| Coarse Pyrite | 6700-150 |
| Very Fine Pyrite | 150-44 |
| Ultra Fine Pyrite | ≦44 |

FIGS. 1-4 illustrate systems and methods for processing a mined or extracted material (e.g., coal and minerals) to remove impurities therefrom, according to various embodiments of the present invention. Referring initially to FIG. 1, systems and methods for processing coal having a high ash content (i.e., coal containing a high content of impurities, according to some embodiments of the present invention, are illustrated. Coal with high ash content may include waste coal, run-of-mine coal, freshly mined coal, etc. In the illustrated embodiment, coal, such as run-of-mine coal 5, previously processed coal from ponds 10, and previously processed coal from stockpiles 15, is fed into a hopper and feeder 20 that creates a material stream with a controlled throughput. The material stream may be subjected to screening operations 25 to remove oversized material and debris. Screening operations may include the use of fixed and/or vibrating screens to control the largest fragment size to be processed.

Although not illustrated, prior to entry into the hopper/feeder 20, the material (5, 10, 15) may be subjected to crushing operations. For example, the material may be crushed such that no particles are larger than about one inch (1") or about one-half inch (½"). Crushing operations can be site-specific and may vary depending on the type of coal to be processed. Variations in preparing the feed material as a metered feed into the dryer system (described below) may require some flexibility in process options based upon the size of the feed, moisture of the feed, and the potential for agglomerated particles such as those with a high clay content.

After screening operations 25 to remove oversize materials and debris, the material stream is fed into a dryer 30 that has a plurality of rotating paddles and baffles therein. An exemplary dryer is a modified AST (air swept tubular) dryer available from Scott Equipment Company, New Prague, Minn., and which is described in U.S. Pat. No. 5,570,517, the disclosure of which is incorporated herein by reference in its entirety. The dryer 30 performs two functions: 1) moisture in the material stream is reduced, for example, to less than about 1%; and 2) due to impact and attrition in the dryer on the agitator plates and retention plates, the softer coal is reduced in particle size while the particles of the harder impurities (e.g., silica, clay, etc.) are largely unaffected. Coarser particles of harder, heavier minerals such as silica, clay, and free sulfur may also be slightly reduced in size but to a much lesser degree based upon their greater resistance to particle size reduction by forces such as impact, attrition, and autogenous crushing.

The illustrated dryer 30 includes an impact agitation section 30*a*, and two agitator attrition sections 30*b*, 30*c*. The material stream is forced through a plurality of rotating paddles and baffles in the AST dryer 30. The rotating paddles and baffles beat and flop the airborne material particles around within the dryer such that, as the softer coal particles dry, they are pulverized. Heat and air are added into the impact agitation section 30*a*.

The impact agitation section 30*a* can have various lengths and includes tightly spaced paddles parallel to the dryer tube with a nominal clearance of about one-half inch (½") to the dryer tube walls. Incoming feed in the dryer 30 is subjected to impact from the paddles and to attrition action against itself in this section of the process. The two agitator attrition sections 30*b*, 30*c* include variable numbers of adjustable paddles, depending on the application, that have a nominal clearance of about one-half inch (½") to the dryer tube wall and can be adjusted to cause material to be conveyed either forward, backward or remain neutral without moving forward or backward. This adjustability allows an operator to vary the drying time, and thereby achieve "selective pulverization" of the coal to a specific particle size.

Material in contact with the hot air stream in the dryer 30 forms a bed of material that causes attrition action between coal particles. This allows the softer coal particles to be further reduced in size while the harder ash minerals maintain their size. Applicants have discovered that mineral particles have a specific settling rate in an air stream based upon their size and bulk density (specific gravity). As such, the air stream within the dryer 30 is used to direct coal particles that have reached a certain reduced size to the air classifier 35.

In some embodiments, a series of round plates, referred to as air dams, are located in the agitator attrition sections 30*b*, 30*c* and help retain material in the attrition sections to facilitate attrition. These plates may be installed substantially perpendicular to the dryer shell and can have variable widths.

Figure 5A:
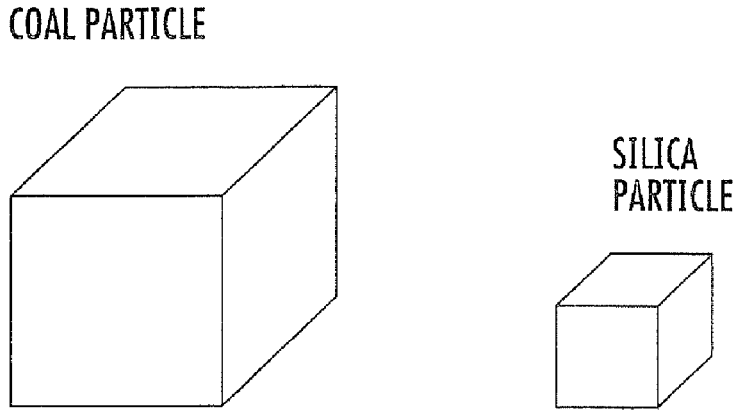
FIG. 5A illustrates the relative sizes of a coal particle and a silica particle prior to pulverizing operations in the waterless methods of FIGS. 1-3.
Figure 5B:
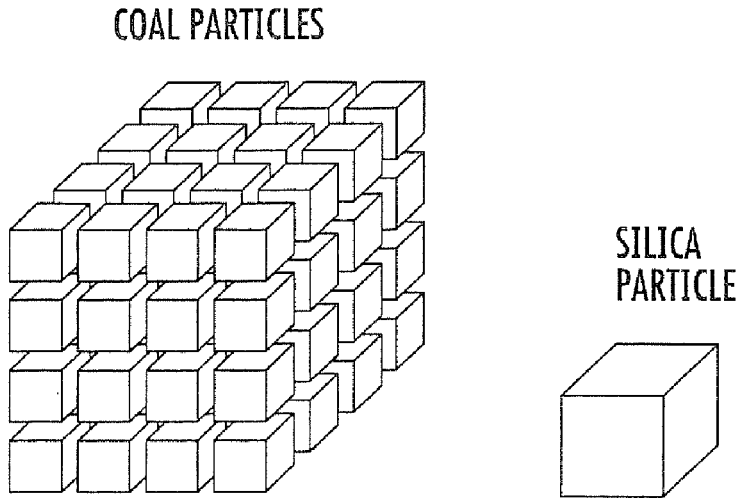
FIG. 5B illustrates the relative sizes of a coal particles and a silica particle after pulverizing operations in the waterless methods of FIGS. 1-3.

FIG. 5A illustrates the relative sizes of a coal particle and a silica impurity particle prior to pulverizing in the dryer 30. FIG. 5B illustrates the relative size of individual coal particles and a silica particle after pulverizing operations in the dryer 30. As illustrated, the softer coal particle is pulverized into many smaller particles while the impurity particle remains substantially the same size.

Some coal may include clays (often weathered shales and slates) having an ultra fine particle size (e.g., <20 microns). As the coal is pulverized in the dryer 30, these ultra fine clays are liberated from the coal particles. The coal particles remain significantly coarser than the ultra fine clays, however. For example, coal feed stock with a nominal 1" top size can be pulverized within the dryer 30 into multiple pieces (e.g., about 90 pieces), each with a particle size of about 37 microns, while at the same time liberating fine clay particles. The reduction of particle size in the pulverization and attrition sections of the dryer 30 serves to scrub clay from the surface of the coal particles and to liberate clay from within those particles that are bound up and not easily segregated by conventional coal separation technologies. The finer the coal particle size, the greater the probability that impurities will in fact be liberated via embodiments of the present invention.

The pulverized coal particles, once they are sufficiently dry and sufficiently small, become entrained in the air stream and are removed from the dryer 30 for subsequent separation. According to embodiments of the present invention, the heated air stream within the dryer may have a temperature of between about 500° F. and about 1,000° F., and may have a flow rate of between about ten thousand cubic feet per minute and about fifty thousand cubic feet per minute (10,000-50,000 cfm).

Dried material exiting from the dryer 30 is subjected to an air classification step in a classifier 35 to separate the coal from the non-coal minerals and other impurities. The air classifier 35 accomplishes this by two methods: 1) the larger unground minerals are separated by particle size; and 2) the non coal minerals (clays, fine silica) are removed due to their high specific gravity (e.g., about 2.6) relative to the coal specific gravity of about 1.3.

Air classification 35 may be a multiple step process. Coarse impurities may be separated from the pulverized coal in one or more stages and ultra fine clay particles may be separated from the pulverized coal in one or more stages, for example.

In the illustrated embodiment of FIG. 1, an in-line air classifier 35 is located between the dryer 30 and baghouse 40. A secondary classifier (not shown) may be placed after the bag house 40 for further classification and to enhance coal recovery. An exemplary classifier that may be utilized in accordance with embodiments of the present invention is manufactured by RSG, Inc., Sylacauga, Ala. Such a classifier includes a round rotating cage sized to the tonnage needed inside a receiver vessel. The cage is mounted on a center shaft with an electric motor drive. The motor is energized by a variable frequency drive to allow speed of rotation to be varied. The cage may be built similar to a squirrel cage fan with varying widths of vanes and spacing. The cage is built into the receiver vessel with very close tolerance (e.g., <0.0025 inch, etc.). Dried material that enters the vessel exits via the spacing between the vanes.

By virtue of air flow (speed) and cage speed, larger particles and/or higher specific gravity particles are not permitted through the cage and finer, lighter particles pass through the cage creating a particle size and specific gravity differentiation of the incoming dried product. Ash (i.e., impurities) is separated from coal based on particle size and the fact that the coal has a specific gravity of about 1.3 vs. a specific gravity of about 2.6-5.0 for non-coal or ash. Coal particles exiting from the classifier 35 may be, for example, less than about 74 micron (200 mesh) in size, and can be, for example, about 53 micron (270 mesh) in size. Non-coal particles that are removed are typically 44 microns (325 mesh) in size and greater, however higher specific gravity particles (e.g., >4.0, etc.) smaller than 44 microns (325 mesh) may be removed due to differences in the specific gravity versus the coal. Coal particles in the size range of 8 microns to 37 microns can be isolated in classification equipment from ultra fine clays (e.g., 2 micron clay) even though the specific gravity of the clay is higher due to the significant particle size difference.

Embodiments of the present invention are not limited to any particular coal particle size resulting from pulverization in the dryer 30. Coal particle sizes produced in accordance with embodiments of the present invention may vary depending on the source of the coal being processed, for example.

Particle sizes can be varied in the process to enhance coal recovery and impurities separation by making adjustments to the AST dryer 30 (i.e., selective pulverization). For example, coal with a particle size as fine as 325 mesh can be achieved in accordance with some embodiments of the present invention. Adjustments to the AST dryer 30 may include changes to paddle configuration, size, orientation, number, as well as spacing between adjacent paddles, etc. Adjustments to the AST dryer 30 to enhance grinding and attrition include, but are not limited to, adjusting the paddles, as described above, to give more retention time in the attrition sections 30*b*, 30*c*; adding additional length to the impact agitation section 30*a* to achieve more impact; increasing the number of paddles; constructing a dryer with a longer tube length to give more retention time, etc.

Still referring to FIG. 1, in some embodiments the separated coal exiting from the classifier 35 is a light, fine material, for example having a particle size in the range of 6700-74 microns. This fine coal may then be, but is not required to be, subjected to further operations 40 to facilitate handling and transfer. For example, the coal can be subjected to pelletizing or briquetting operations. The terms pelletizing and briquetting are interchangeable and are intended to refer to all forms of creating pellets, briquettes, logs, blocks or other coal agglomerates wherein coal fines are processed into a concrete material that facilitates handling. Processes for pelletizing and/or briquetting coal fines conventionally involve saturating the coal with a solution/binder and pressing or otherwise forming the material into blocks or lumps, and then drying the material by suitable means. Various pelletizing and/or briquetting processes may be utilized with embodiments of the present invention, without limitation. In some embodiments of the present invention, binders such as coal tar pitch are used in pelletizing/briquetting operations. Such binders may involve as little as 2% binder by weight and can include corn starch, molasses, coal tar pitch, as well as proprietary binders.

Figure 2:
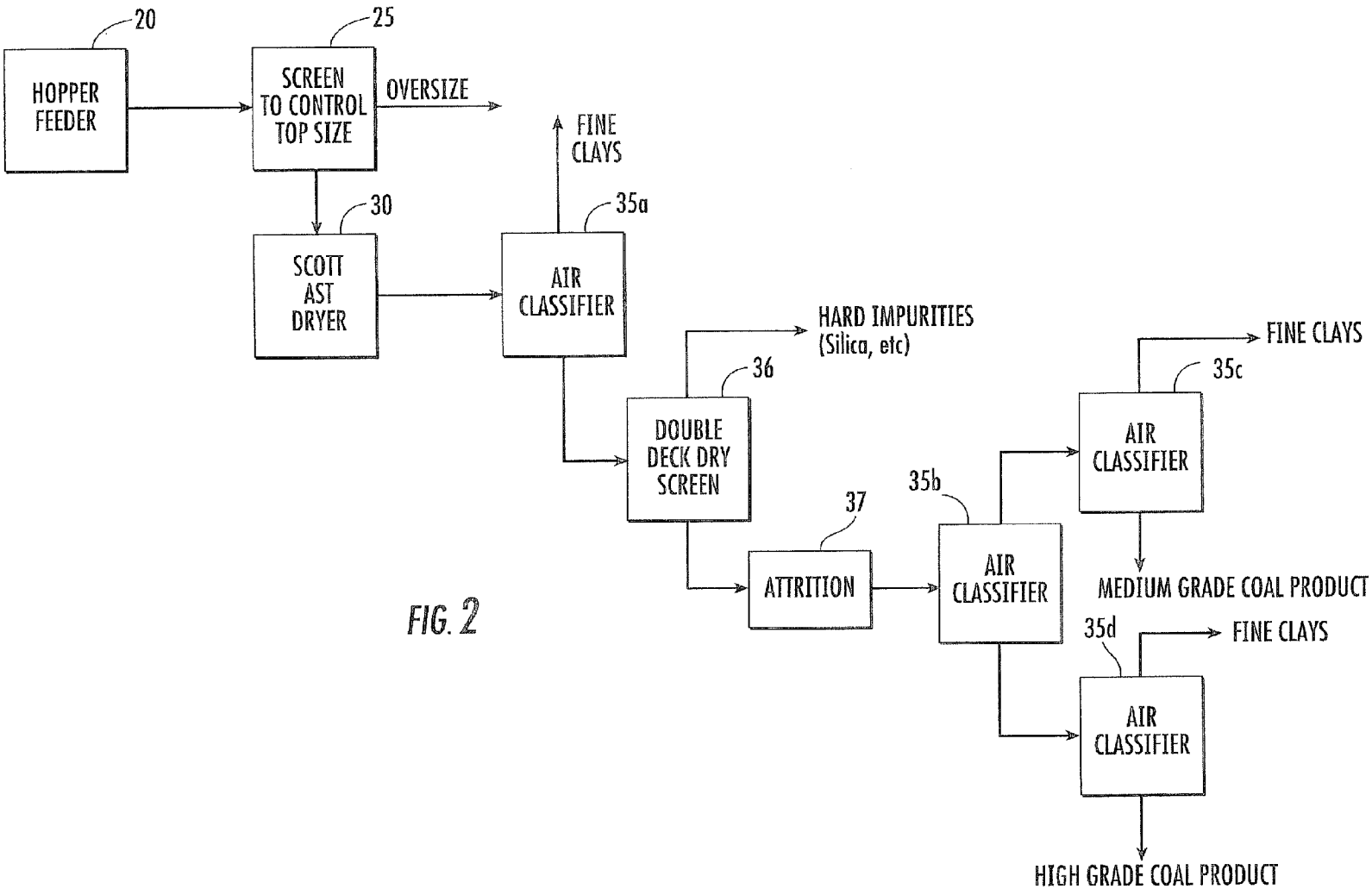

Referring to FIG. 2, a process for removing impurities from coal, wherein the primary impurities within the coal are ultra fine clays, is illustrated according to some embodiments of the present invention. The illustrated process is similar to that of FIG. 1, but includes multiple air classifier stages 35*a*, 35*b*, 35*c*, 35*d*. The multiple air classifier stages narrow the particle size range as material moves through each subsequent air classifier, thereby improving efficiency. Each air classifier stage in FIG. 2 performs the same function. By using multiple stages, the probability that most of the pulverized coal is recovered and that most of the impurities are rejected, is increased. In the illustrated embodiment, ultra fine clays are separated from the coal in the air classifier first stage 35*a*. The dried material continues to a double deck dry screen 36, the function of which is to retain coarse impurities, i.e., the non pulverized hard silica, while allowing the softer, finer, pulverized coal to pass through the screen for further classification. The screen 36 can be an effective choice for sizing larger particles that have been dried to a particle size as coarse as 250 microns as a reference point. Finer sizing of minerals below that nominal size can be done but may require additional screening equipment.

In the process of FIG. 2, coal is fed into a hopper and feeder 20 that creates a material stream with a controlled throughput. The material stream may be subjected to screening operations 25 to remove oversized material and debris. Screening operations may include the use of fixed and/or vibrating screens to control the largest fragment size to be processed. After screening operations 25 to remove oversize materials and debris, the material stream is fed into a Scott AST dryer 30 that has a plurality of rotating paddles and baffles therein, as described above.

The material stream exiting the Scott AST dryer 30 is directed to an initial air classifier stage 35*a* wherein fine clay particles are removed and the remaining material is subjected to screening 36, such as a double deck dry screen. Screening removes hard impurities, such as silica from the material stream and the remaining material stream is subjected to a second attrition operation 37, for example via a second Scott AST dryer or another similar device, wherein the coal particles are further reduced in size. After the second attrition operation 37, the dried material continues to an air classifier second stage 35*b*. Impurities separated in the air classifier second stage 35*b* are directed to an air classifier third stage 35*c* and to an air classifier fourth stage 35*d*. Ultra fine clays are separated from the coal in the air classifier third stage 35*c* and a medium grade coal product results. Ultra fine clays are separated from the coal in the air classifier fourth stage 35*d* and a high grade coal product results. In some embodiments, the ultra fine clays are subjected to calcining operations to produce a calcined clay product.

Figure 3:
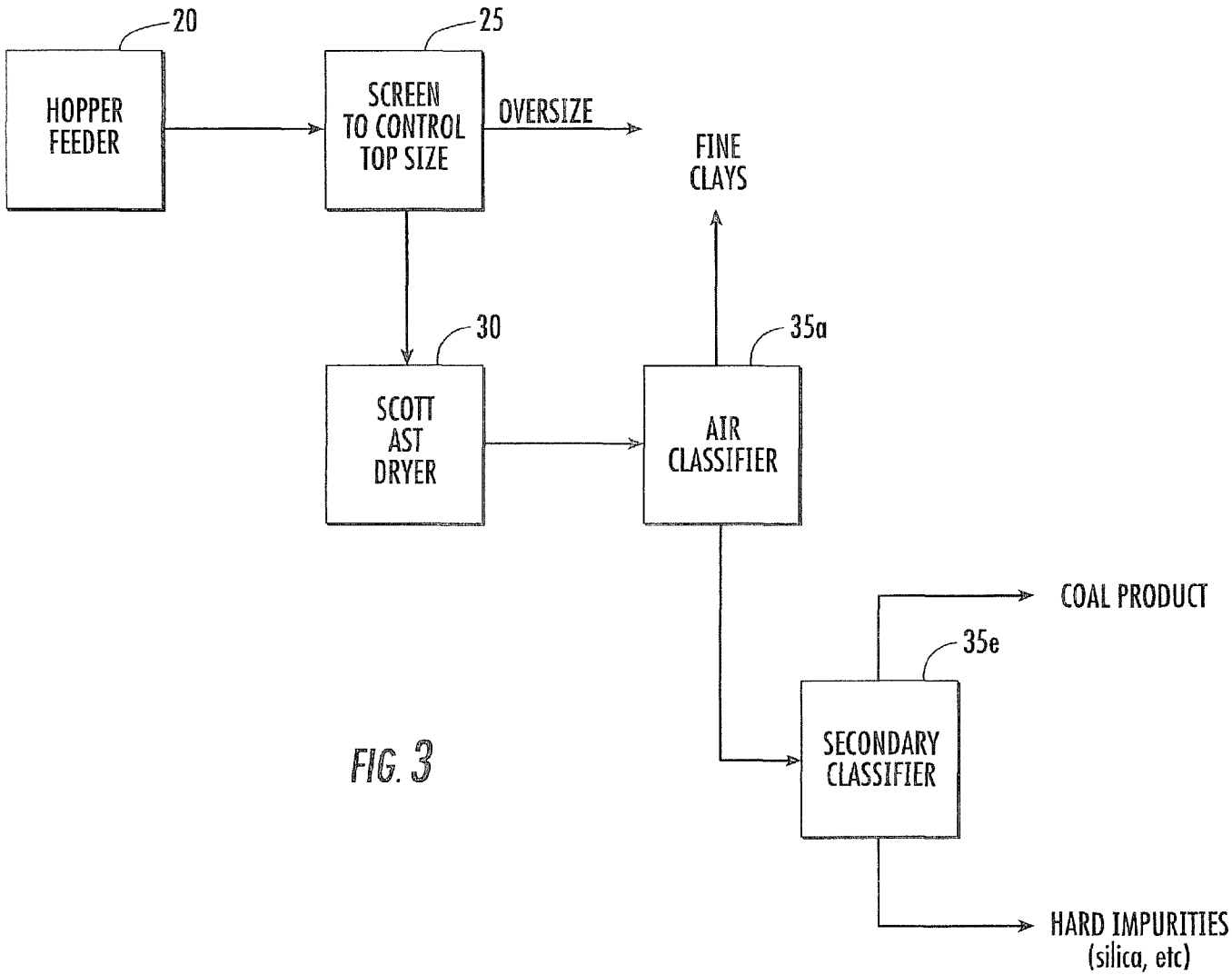

Referring to FIG. 3 a process for removing impurities from coal, where the impurities include ultra fine clays and hard, coarse impurities, such as silica and sulfur, is illustrated. The illustrated process is similar to that of FIG. 1, but includes two air classifier stages. In the first air classifier stage 35*a*, ultra fine clays are removed and in the second air classifier stage 35*e*, hard impurities are removed.

In the process of FIG. 3, coal is fed into a hopper and feeder 20 that creates a material stream with a controlled throughput. The material stream may be subjected to screening operations 25 to remove oversized material and debris. Screening operations may include the use of fixed and/or vibrating screens to control the largest fragment size to be processed. After screening operations 25 to remove oversize materials and debris, the material stream is fed into a Scott AST dryer 30 that has a plurality of rotating paddles and baffles therein, as described above. The material stream exiting the Scott AST dryer 30 is directed to the air classifier stage 35*a* wherein fine clay particles are removed, and which may be subsequently subjected to calcining operations. The remaining material is directed to the second air classifier stage 35*e* where hard impurities are removed from the coal product.

Coal processing according to embodiments of the present invention is advantageous over conventional coal processing because much finer coal particle size reduction can be achieved and a high degree of liberation of impurities can be achieved. In addition, embodiments of the present invention can be applied by various industries that use coal to isolate various impurities, such as mercury (13.3 specific gravity) and to dry the coal, thereby raising the BTU level.

Embodiments of the present invention are not limited solely to the processing of coal. Other minerals and materials that are mined or extracted and that can undergo particle size reduction in an impact or attrition environment can be processed in accordance with embodiments of the present invention including, for example, kaolin, limestone, clay, slag, and the like.

Figure 4:
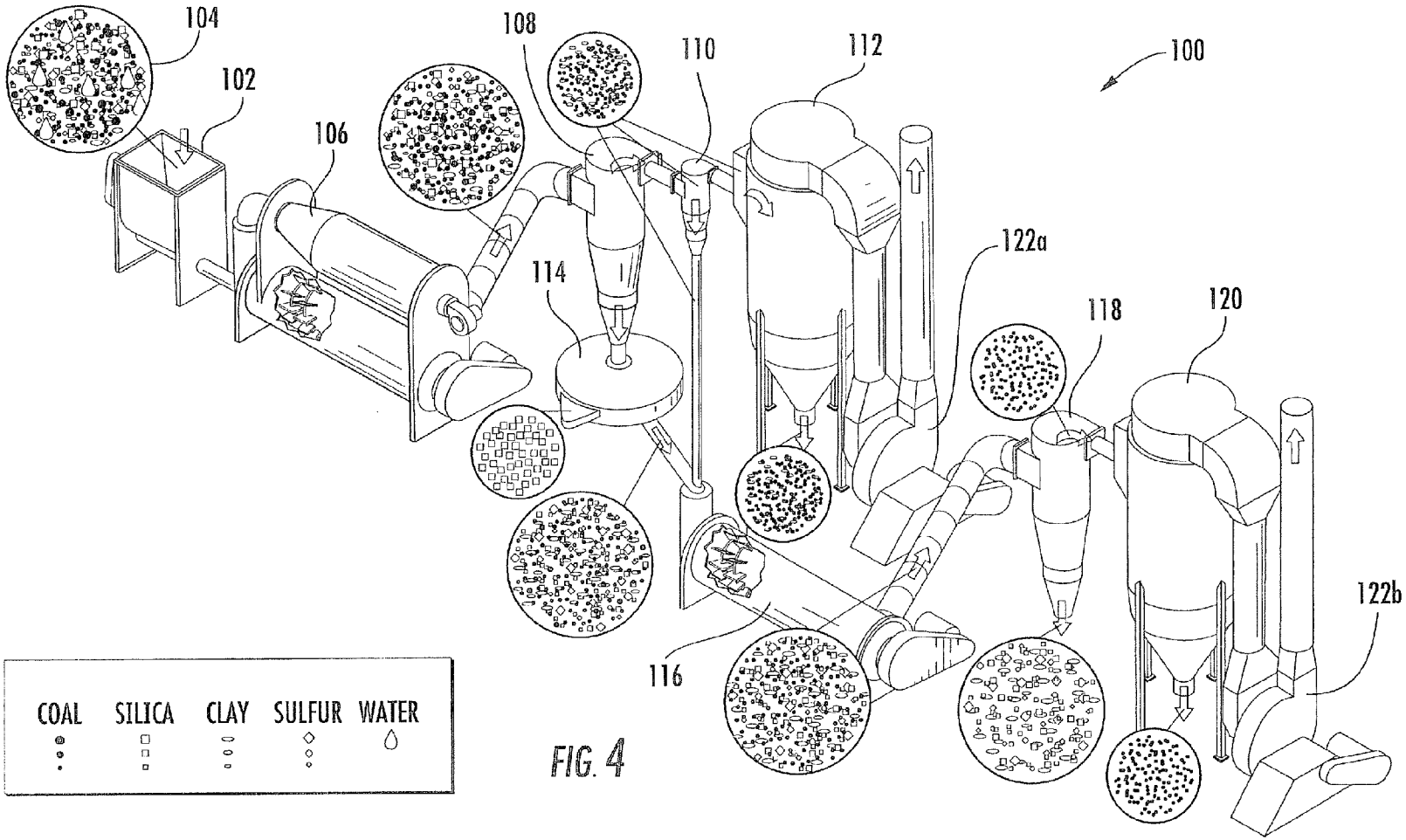
FIG. 4 is a perspective view of a system for waterless processing of coal and other mined/extracted materials, according to some embodiments of the present invention.

Referring now to FIG. 4, a system 100 for waterless processing of coal and other mined/extracted materials, according to some embodiments of the present invention, is illustrated. A hopper/feeder 102 receives feed material 104 containing coal, impurities (such as clay, silica and pyrites), as well as moisture (which bonds the various minerals together with the coal), and feeds the material into a dryer/pulverizer 106.

In some embodiments, the hopper/feeder 102 includes a screen that only allows feed material 104 having a size of roughly one inch or less (≦1") to proceed. Although not illustrated, prior to entry into the hopper/feeder 102, the material 104 may pass through a crusher. The dryer/pulverizer 106 includes a plurality of rotating paddles and baffles therein. An air stream heated via a burner forces the material 104 through the plurality of rotating paddles to pulverize the coal into individual particles and to liberate the impurity particles. In the illustrated system 100, the air stream is created by a pair of fans 122*a*, 122*b*, as would be understood by those skilled in the art of the present invention. An exemplary dryer/pulverizer 106 is a modified AST dryer described above. The dryer/pulverizer 106 pulverizes the coal in the feed material 104 and reduces the coal particles from a fine size (e.g., in a range of about 6700-660 microns) to very fine particles having a size of about 660-44 microns. The impurity particles are substantially unchanged in size by the pulverizing operation in the dryer/pulverizer 106.

Downstream from the dryer/pulverizer 106 is an air classifier 108 that receives the material coming out of the dryer/pulverizer 106 and that is configured to separate the material into separate product streams according to particle size and specific gravity. For example, the air classifier 108 separates ultra fine coal particles (e.g., ≦44 microns) and ultra fine clay particles (e.g., ≦44 microns) from the material and discharges these out of the top and into the cyclone 110. The ultra fine clay particles and ultra fine coal particles exit the top of the cyclone 110 to the dust collector 112, also referred to as a bag house.

The bottom discharge of the cyclone 110 includes very fine coal particles (e.g., ≦74 microns) only. The bottom discharge of the air classifier 108 includes very fine coal particles (e.g., 660-44 microns), fine silica particles (e.g., 6700-150 microns), very fine silica particles (e.g., ≦150 microns), fine clay particles (e.g., ≦20 microns), very fine pyrites (e.g., ≦150 microns) and ultra fine pyrites (e.g., ≦44 microns). The air classifier 108 includes a screen 114 at the bottom thereof that removes hard impurities, such as silica.

A second pulverizer or attrition mill 116 is positioned downstream from the screen 114 and receives the material that passes through the screen 114 and the material discharging from the bottom of the cyclone 110. This material entering the second pulverizer includes very fine coal particles, very fine silica particles, very fine clay particles, very fine pyrites and ultra fine pyrites. The second pulverizer 116 further pulverizes the coal particles into ultra fine coal particles and the discharge enters a second air classifier 118. The ultra fine coal particles are separated by the second air classifier 118 and enter the second dust collector 120, also referred to as a bag house. The product stream exiting from the bottom of the second air classifier 118 includes very fine silica, very fine clay, very fine pyrites, and ultra fine pyrites.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A waterless method of processing coal to remove impurities therefrom, the method comprising:

drying a batch of coal to remove moisture therefrom, by injecting the coal into a heated air stream having a flow rate through a dryer of between about ten thousand cubic feet per minute and about fifty thousand cubic feet per minute (10,000-50,000 cfm), wherein a temperature of the heated air stream is maintained between about 500° F. and 1,000° F.;

pulverizing the coal into individual coal particles, wherein pulverizing the coal liberates impurity particles from the coal without substantially reducing the size of the impurity particles; and separating the impurity particles and pulverized coal particles into respective product streams via air classification.

2. The method of claim 1, wherein the drying and pulverizing steps occur substantially simultaneously.

3. The method of claim 1, wherein the dryer comprises a plurality of rotating paddles, and wherein the air stream forces the coal through the plurality of rotating paddles to pulverize the coal into individual particles.

4. The method of claim 1, wherein the separating step comprises producing a first product stream of ultra fine coal particles and a second product stream of very fine coal particles and impurities.

5. The method of claim 4, further comprising:

pulverizing the very fine coal particles in the second product stream into ultra fine coal particles without substantially reducing the size of impurity particles in the second product stream; and separating the impurity particles and ultra fine coal particles into respective third and fourth product streams via air classification.

6. The method of claim 5, wherein pulverizing the very fine coal particles in the second product stream comprises injecting the second product stream into an attrition mill having a plurality of rotating paddles, and forcing the second product stream through the plurality of rotating paddles.

7. The method of claim 4, further comprising pelletizing the ultra fine coal particles.

8. The method of claim 1, wherein the pulverizing step produces individual coal particles having a size less than about 74 microns.

* * * * *